US007900295B2

(12) United States Patent
Lev

(10) Patent No.: US 7,900,295 B2
(45) Date of Patent: Mar. 8, 2011

(54) SHOWER HANDLE WATER SUPPLY DIVERTER SYSTEM

(76) Inventor: Mordechai Lev, West Bloomfield, MI (US)

( * ) Notice: Subject to any disclaimer, the term of this patent is extended or adjusted under 35 U.S.C. 154(b) by 1240 days.

(21) Appl. No.: 11/486,169

(22) Filed: Jul. 13, 2006

(65) Prior Publication Data

US 2007/0158460 A1 Jul. 12, 2007

Related U.S. Application Data

(60) Provisional application No. 60/699,005, filed on Jul. 13, 2005.

(51) Int. Cl.
*A47K 3/00* (2006.01)

(52) U.S. Cl. ..... 4/615; 4/567; 4/601; 239/444; 239/447

(58) Field of Classification Search ..... 4/601, 615–618, 4/567, 605; 239/443–449, 132.1, 282, 556, 239/392; 137/625.48, 872
See application file for complete search history.

(56) References Cited

U.S. PATENT DOCUMENTS

| | | | | |
|---|---|---|---|---|
| 2,596,367 | A | 5/1952 | Ellinger | |
| 2,949,240 | A * | 8/1960 | Koolnis | 239/200 |
| 3,722,800 | A * | 3/1973 | Shames et al. | 239/447 |
| 3,776,469 | A | 12/1973 | Joannon | |
| 4,629,125 | A * | 12/1986 | Liu | 239/443 |
| 4,934,000 | A * | 6/1990 | Freedman | 4/597 |
| 5,048,759 | A | 9/1991 | Mazziotta | |
| 5,135,173 | A | 8/1992 | Cho | |
| 5,961,049 | A | 10/1999 | Kaps et al. | |
| 6,038,715 | A * | 3/2000 | Flieger et al. | 4/601 |
| 6,178,981 | B1 | 1/2001 | Wales | |
| 6,338,170 | B1 | 1/2002 | De Simone | |
| 6,409,148 | B1 | 6/2002 | Dempsey et al. | |
| 6,779,207 | B2 | 8/2004 | Ekeroth | |
| 6,935,375 | B2 | 8/2005 | Blessing | |
| 7,143,961 | B1 * | 12/2006 | Wu et al. | 239/446 |
| 2006/0243330 | A1 | 11/2006 | Abanto | |

FOREIGN PATENT DOCUMENTS

| | | | |
|---|---|---|---|
| DE | 34 02545 | A1 | 8/1985 |
| DE | 37 26788 | A1 | 2/1989 |
| EP | 0 437 164 | A2 | 12/1990 |
| JP | 11-158956 | | 6/1999 |
| JP | 2000120119 | | 4/2000 |

* cited by examiner

*Primary Examiner* — Gregory Huson
*Assistant Examiner* — Janie Christiansen
(74) *Attorney, Agent, or Firm* — Gifford, Krass, Sprinkle, Anderson & Citkowski, P.C.

(57) ABSTRACT

A shower handle water supply diverter system includes a water supply in fluid communication with a hose. A handle sprayer is in fluid communication with and extends from the hose. A water diverter is provided within the handle sprayer and is in fluid communication with the showerhead. The water diverter can be operated in three modes: handle sprayer only water expulsion, shower head only water expulsion, and simultaneous handle sprayer and shower head water expulsion. By placement of the first hose and second hose in proximity to provide thermal contact therebetween, stagnant water in one hose at ambient temperature exchanges heat with water flow at a particular temperature in a second hose to change stagnant water temperature towards the temperature of the water flow.

17 Claims, 4 Drawing Sheets

SHOWER HANDLE WATER SUPPLY DIVERTER SYSTEM

RELATED APPLICATION

This application claims priority of U.S. Provisional Patent Application Ser. No. 60/699,005 filed Jul. 13, 2005, which is incorporated herein by reference.

FIELD OF THE INVENTION

The present invention in general relates to a shower fixture and in particular to a shower fixture having a water supply diverter integral with a handheld water supply.

BACKGROUND OF THE INVENTION

A diverter switch is commonly found at an overhead shower fixture junction in order to supply water to a handheld water supply. While the location of a conventional diverter switch greatly simplifies the shower system design, the placement of the diverter switch proximal to the water supply makes access to the switch difficult for children or a user with physical disabilities. As a result, children and disabled users are either denied the option of using a handheld water supply or are susceptible to injury in attempting to reach to gain access to the diverter switch. Additionally, a conventional shower system having a handle in fluid communication with a water supply by way of a diverter switch located at the overhead shower fixture junction results in the length of tubing extending from the diverter switch to the handheld water supply being filled with ambient temperature water such that upon activating the handheld portion of the shower system, a spray lasting several seconds is emitted from the handle sprayer that is not of the user selected shower temperature.

A further limitation associated with a conventional diverter switch is that a user is forced to make a binary selection between a fixed showerhead and a handheld sprayer. As a result, a user is forced to polarize their selection as to desired water source even though the optimal water supply may well be a combination of fixed showerhead and handheld sprayer water supplies.

Thus, there exists a need for a shower handle water supply diverter. Additionally, there exists a need for a shower water diverter switch providing a graded flow between a fixed showerhead and a handle sprayer.

SUMMARY OF THE INVENTION

A shower handle water supply diverter system includes a water supply in fluid communication with a hose. A handle sprayer is in fluid communication with and extends from the hose. A second hose extends from the shower handle in fluid communication to a shower head. A water diverter is provided within the handle sprayer and is in fluid communication with the hose and the second hose. The water diverter optionally has three modes: handle sprayer only water expulsion, shower head only water expulsion, and simultaneous handle sprayer and shower head water expulsion. By placement of the first hose and second hose in proximity to provide thermal contact therebetween, stagnant water in one of the first hose and second hose at ambient temperature exchanges heat with water flow in the other of the first hose and the second hose at a particular temperature to change stagnant water temperature towards the temperature of the water flow.

A shower handle water supply diverter system is also provided that couples a water supply to a diverter having a first position and a second position. The diverter is in fluid communication with, and in proximity to the water supply. A showerhead is in fluid communication with the water supply when the diverter valve is in the first position. A hose is coupled to the diverter valve and in fluid communication with the diverter when the diverter is in the second position. A spray handle extends from the hose and has a diverter knob within the handle sprayer for switching the diverter valve between the first and second positions through mechanical movement of a wire extending between the knob and the diverter.

DETAILED DESCRIPTION OF THE PREFERRED EMBODIMENTS

The present invention has utility as a diverter containing bathroom shower water supply. The present invention includes a water diverter within the handle of a shower spray system including a fixed showerhead and a handheld sprayer. An inventive diverter allows a user to elect a shower spray from the fixed showerhead only, the handle only, or a combination of both the fixed showerhead and the handle. The present invention affords the advantage of ease of access especially for a child or a user having physical disabilities. An inventive water diverter is further detailed with respect to the following drawings.

Figure 1:
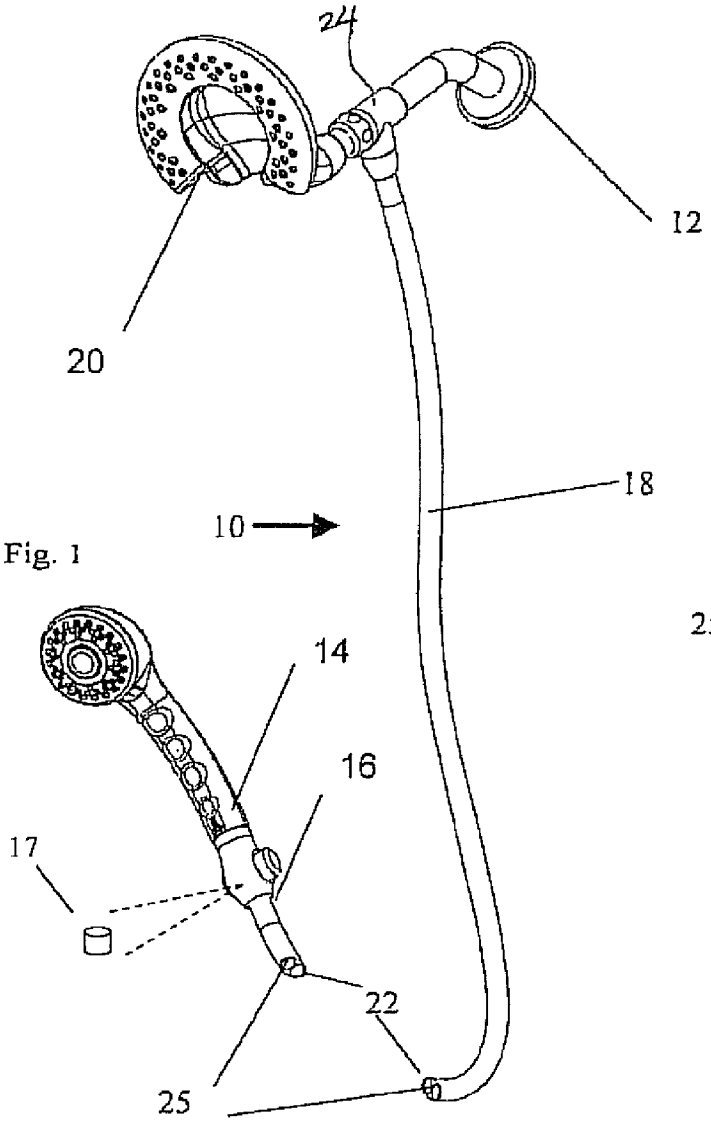
FIG. 1 is a perspective view of an inventive shower handle water supply diverter system.

Referring now to FIG. 1, the inventive system is shown generally at 10. The system includes a wall mounted water supply 12, in fluid communication with a handle sprayer 14 by way of a diverter 17 connected to a diverter switch 16 and a hose 22. The water supply 12 is also in fluid communication with a showerhead 20 by way of hose 22, diverter switch 16, and hose 25. Hoses 22 and 25 are illustratively shown in a unified hose housing 18.

Figure 3:
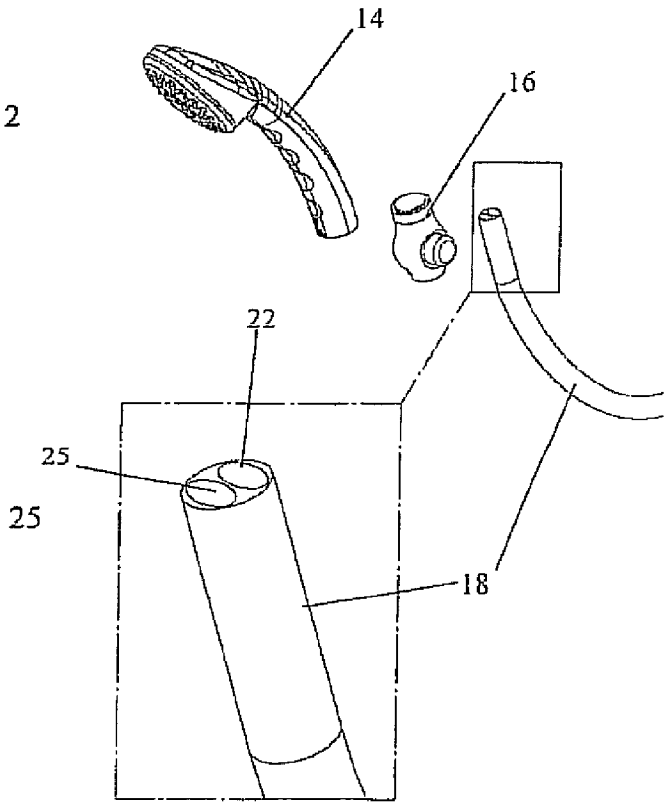
FIG. 3 is an exploded view of the handle portion of the system depicted in FIG. 1 with the inset box being an enlarged view of a hose housing end.
Figure 2:
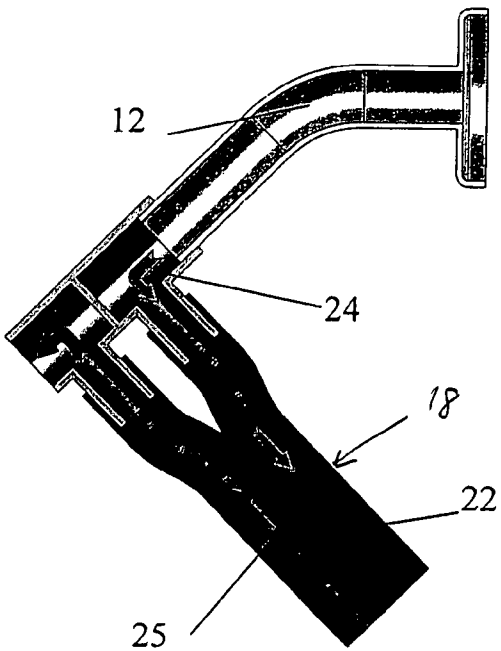
FIG. 2 is a cross-sectional view of a water supply, hose coupling and hoses as depicted in FIG. 1.

Referring now to FIGS. 2 and 3 where like numerals correspond to those described with respect to FIG. 1, water flows from the water outlet 12 into a first hose 22 by way of a preferred hose coupling 24. It is appreciated that in lieu of coupling 24 a hose 22 is directly secured to the water supply and the showerhead 20 need not be mounted in proximity to the water supply 12 but instead is mounted anywhere within reach of hose 25. Hose 22 is in fluid communication with the handle sprayer 14 by way of diverter 16. If a user sets the diverter 16 to shower handle sprayer only, water flows from hose 22 through the diverter 16 and is expelled from handle sprayer 14 only. Should the user set the diverter to shower head 20 only, water travels the length of hose 22 and is redirected by diverter 16 via hose 25 to the showerhead 20 with no water being expelled through the handle sprayer 14. In the instance where the user sets the diverter 16 in a dual expulsion mode, a portion of the water stream delivered via hose 22 passes diverter 16 and is expelled from handle sprayer 14 while a portion of the water delivered via hose 22 is returned via hose 25 and expelled through the shower head 20. This graded flow between showerhead 20 and handle sprayer 14 affords a user with a high degree of control over flow conditions. Additionally, the flow of water within either of hose 22 or 25 provides conductive thermal exchange with the stagnant water in the unused one of hoses 22 and 25, such that activation of the stagnant water hose provides an initial burst of water that is a temperature intermediate between ambient shower room temperature and the temperature of water flowing in used hose 22 or 25. While hoses 22 and 25 are depicted as having a unitary hose housing 18, it is appreciated that two separate hose housings, one for each of the hoses 22 and 25, are also operative herein. Additionally, while the hoses 22 and 25 are depicted as having elliptical cross sections of approximately equivalent area (varying less than 45%), it is appreciated that each of the hoses 22 and 25 independently assumes any of a variety of shapes illustratively including round, flat or other polygonal cross section.

It is appreciated that the present invention as described with respect to FIGS. 1-3 is readily retrofit onto an existing shower fixture and the conventional diverter valve is permanently positioned so as to divert complete water supply to the handle sprayer. A coupling providing water supply to the showerhead subsequent to the conventional diverter valve serves to feed water to the showerhead.

Figure 4:
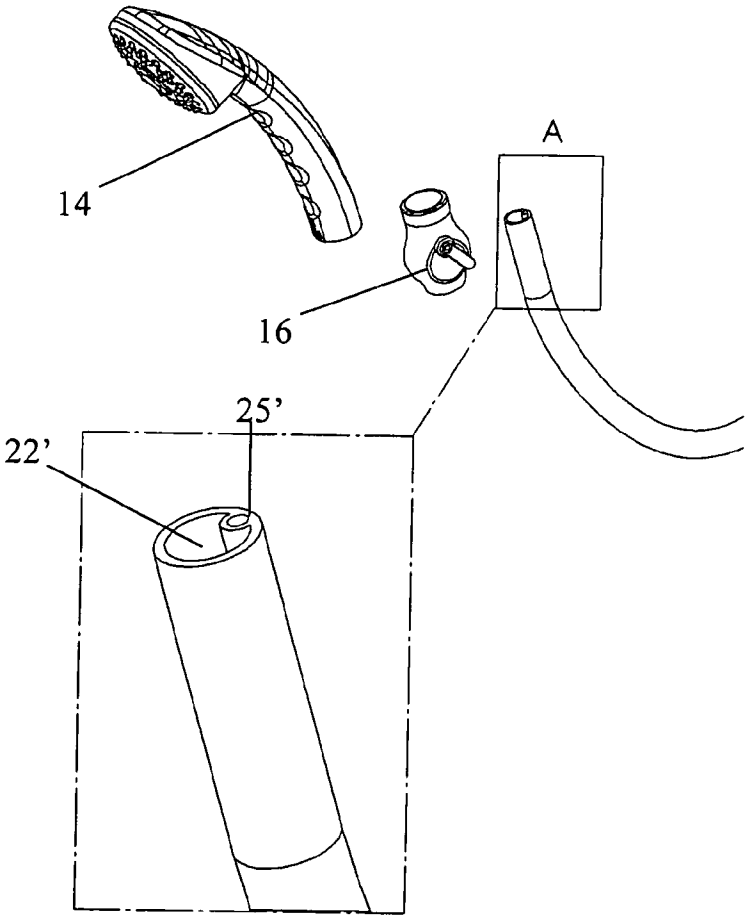
FIG. 4 is an exploded view of a handle portion of the system depicted in FIG. 1 with an alternate embodiment as to relative hose cross-sectional area with the inset being an enlarged view of the terminal hose housing portion depicted in box A.

An alternate hose cross section is depicted in FIG. 4 where the first hose and second hose are denoted as 22' and 25' respectively where the relationship of the first hose 22' and 25' is as described with respect to preceding FIGS. 1-3 with the cross-sectional area difference between 22' and 25' typically being between 3:1 and 20:1, or vice versa.

Figure 5:
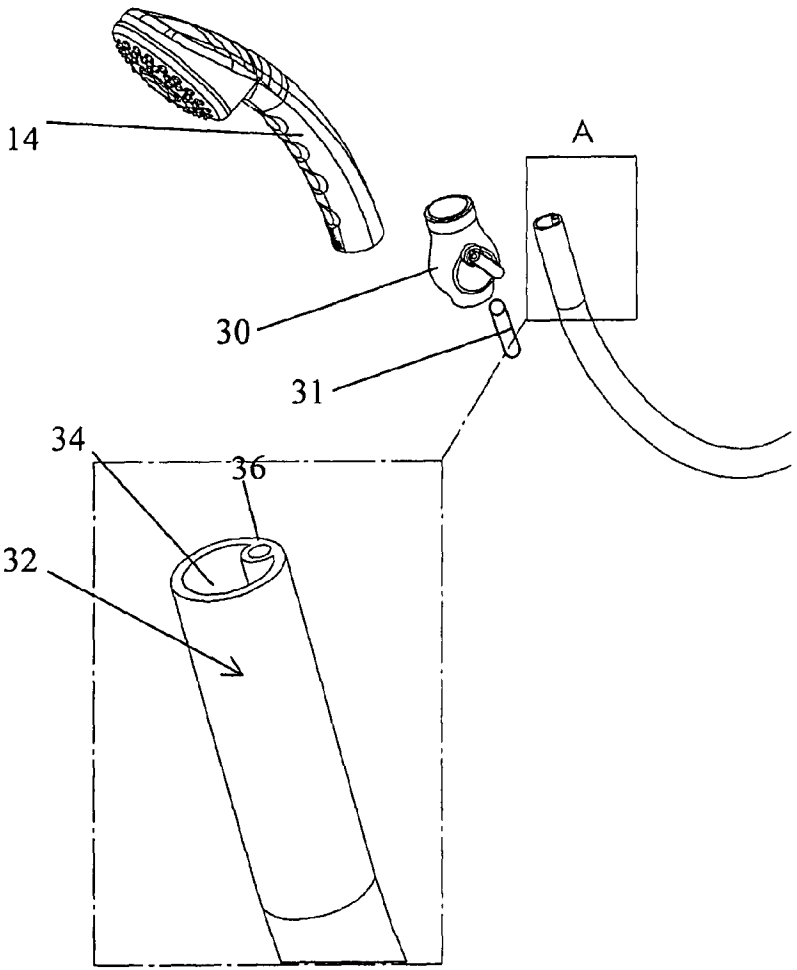
FIG. 5 is an alternate embodiment of a handle portion of an inventive system depicting a diverter knob in mechanical communication with a remote diverter by way of a wire extending along a hose with the inset being an enlarged view of the terminal hose housing portion depicted in box A.

In an alternate embodiment depicted in FIG. 5, the actual diverter valve is retained in the conventional position proximal to the water supply, the diverter valve being manipulated by way of a wire extending from a control knob 30 integrated into a shower handle sprayer 14 as detailed above with respect to preceding FIGS. 1-3. The knob 30 is connected to a wire 31 extending the length of a water delivery hose 32. The water delivery hose 32 having a water delivery channel 34 that is in fluid communication with the water supplied by way of an overhead diverter valve. The water supply hose 32 also includes a wire conduit 36 through which the wire 31 extends from the knob 30 to operate the diverter located within the overhead shower water supply. In operation, by rotating the knob 30, the wire 31 operates the conventional diverter valve to allow water flow to be controlled between a showerhead and the handle sprayer 14. The mechanism of manipulating wire tautness by way of a knob is similar to wire controls found in bicycle brake mechanisms.

Figure 6:
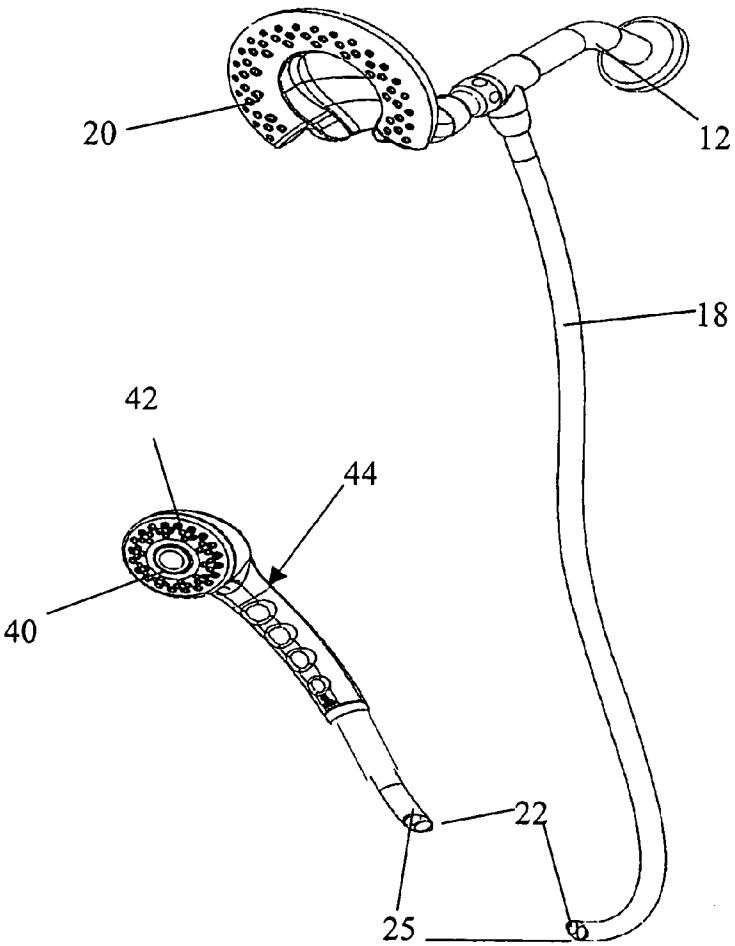
FIG. 6 is an alternate embodiment of an inventive system where a diverter is located within a spray face of a handle spray.

As detailed in FIG. 6, where like numerals correspond to those described with respect to FIGS. 1-3, a diverter and connected knob 40 are located within the faceplate 42 of a shower handle 44. The diverter and connected knob 40 are rotated to urge water through various apertures in the faceplate 42. The various apertures within a faceplate creating different stream effects of water exiting the faceplate 42 and illustratively including those associated with aperture dimensions and patterns such as a needle spray; pulsatile flow; massage effects; a mixed flow between the handle 44 and the showerhead 20; and combinations thereof.

Various hoses detailed with respect to the present invention and various embodiments are each independently formed of conventional elastomeric and thermoplastic materials, and fiber-reinforced forms thereof. Hose housings are formed of the same materials as hoses, as well as conventional forms illustratively including braided polymeric or metal fibers, segmented polymer, or metallic rings. Diverter switch housings, diverter valves, handle sprayers, and showerhead components are all formed of materials conventional to the art.

The foregoing description is illustrative of particular embodiments of the invention, but is not meant to be a limitation upon the practice thereof. The following claims, including all equivalents thereof, are intended to define the scope of the invention.

The invention claimed is:

1. A shower handle water supply diverter system comprising:

a water supply;

a first hose having a first hose cross-sectional area, said hose in fluid communication with the water supply;

a showerhead;

a handle sprayer extending from said hose;

a second hose having a second hose cross-sectional area extending from said sprayer handle in fluid communication with said showerhead; and a water diverter valve within said handle sprayer and in selective fluid communication with each of said first hose and said second hose; said first hose directs water from said water supply to said water diverter valve and said water diverter valve selectively directs water from said first hose to said handle sprayer, to said showerhead via said second hose, or both.

2. The system of claim 1 wherein said showerhead is fixedly wall mounted.

3. The system of claim 1 further comprising a hose housing circumscribing said first hose and said second hose.

4. The system of claim 1 wherein the first hose cross-sectional area is within 45% of the second hose cross-sectional area.

5. The system of claim 1 wherein a ratio of the first hose cross-sectional area to the second hose cross-sectional area is 3-20:1.

6. The system of claim 1 further comprising a hose coupling intermediate between the water supply and said first hose, said hose coupling also intermediate between said second hose and said showerhead.

7. The system of claim 1 wherein said diverter is located within a faceplate of said handle sprayer.

8. The system of claim 7 wherein said diverter has at least three modes selected from the group consisting of: handle sprayer only water expulsion, shower head only water expulsion, and simultaneous handle sprayer and shower head water expulsion.

9. The system of claim 8 wherein handle sprayer only water expulsion is provided with multiple stream effect modes.

10. The system of claim 1 wherein said diverter has at least three modes selected from the group consisting of: handle sprayer only water expulsion, shower head only water expulsion, and simultaneous handle sprayer and shower head water expulsion.

11. The system of claim 3 wherein said first hose and said second hose are in thermal contact such that stagnant water in said second hose at ambient temperature exchanges heat with a water flow at a given temperature in said first hose.

12. A shower handle water supply diverter system comprising:

a water supply;

a first hose having a first cross-sectional area, said hose in fluid communication with the water supply;

a showerhead;

a handle sprayer extending from said hose;

a second hose having a second hose cross-sectional area extending from said sprayer handle in fluid communication with said showerhead;

a water diverter valve within said handle sprayer and in selective fluid communication with each of said first hose and said second hose; said first hose directs water from said water supply to said water diverter valve and said water diverter valve selectively directs water from said first hose to said handle sprayer, to said showerhead via said second hose, or both; and a hose housing circumscribing said first hose and said second hose;

wherein said diverter valve has at least three modes selected from the group consisting of handle sprayer only water expulsion, shower head only water expulsion, and simultaneous handle sprayer and shower head water expulsion.

13. The system of claim 12 wherein the first hose cross-sectional area is within 45% of the second hose cross-sectional area.

14. The system of claim 12 wherein a ratio of the first hose cross-sectional area to the second hose cross-sectional area is 3-20:1.

15. The system of claim 12 further comprising a hose coupling intermediate between the water supply and said first hose, said hose coupling also intermediate between said second hose and said showerhead.

16. The system of claim 12 wherein said diverter is located within a faceplate of said handle sprayer.

17. The system of claim 12 wherein said first hose and said second hose are in thermal contact such that stagnant water in said second hose at ambient temperature exchanges heat with a water flow at a given temperature in said first hose.

* * * * *